United States Patent [19]

Lu

[11] Patent Number: 4,796,391

[45] Date of Patent: Jan. 10, 1989

[54] OVERHANG STRUCTURE

[75] Inventor: Chao-Hsiung Lu, Kaohsiung Hsien, China

[73] Assignee: Formosa Shinn Yuan Industrial Co., Ltd., Taiwan

[21] Appl. No.: 124,570

[22] Filed: Nov. 24, 1987

[51] Int. Cl.[4] ..... E04B 7/02

[52] U.S. Cl. ..... 52/73; 52/11; 52/90

[58] Field of Search ..... 52/90, 73, 11, 146, 52/731, 648, 74, 78

[56] References Cited

U.S. PATENT DOCUMENTS

| | | | |
|---|---|---|---|
| 326,056 | 9/1885 | Overman | 52/90 |
| 2,023,814 | 12/1935 | Lindsey | 52/90 |
| 2,150,217 | 3/1939 | Gettelman | 52/90 |
| 2,692,033 | 10/1954 | Jaynes | 52/73 |
| 2,701,397 | 2/1955 | Taylor | 52/90 |
| 3,084,479 | 4/1963 | Struben | 52/11 |
| 3,869,836 | 3/1975 | Allen | 52/146 |
| 3,984,951 | 10/1976 | Hindman | 52/90 |
| 4,078,341 | 3/1978 | Peterson et al. | 52/90 |
| 4,192,108 | 3/1980 | Lowe | 52/90 |

FOREIGN PATENT DOCUMENTS

| | | | |
|---|---|---|---|
| 581703 | 10/1944 | United Kingdom | 52/90 |
| 2027106 | 2/1980 | United Kingdom | 52/90 |

*Primary Examiner*—David A. Scherbel
*Assistant Examiner*—Caroline D. Dennison
*Attorney, Agent, or Firm*—Kirschstein, Kirschstein, Ottinger & Israel

[57] ABSTRACT

An improved structure assembled with the parts made of light aluminum alloy, roof sheathing such as plastic corrugated boards or polyvinyl fiber glass boards set with assembly nails and drain chains made of resin for draining rain falling on the roof. The parts include a number of posts, a front beam, a rear beam, a number of rafters, a number of auxiliary poles, two fascias and a number of struts. This simple structure is easy to assemble and dismantle and has a long life span and high economic gain.

2 Claims, 9 Drawing Sheets

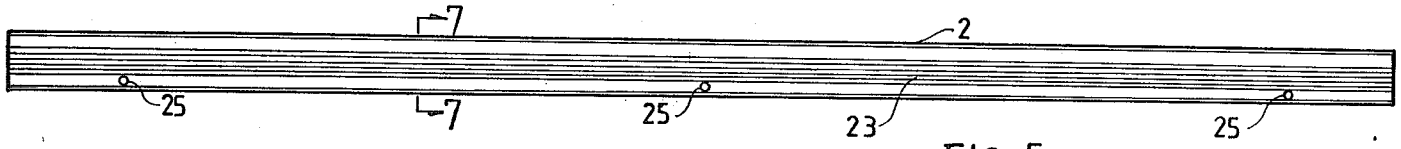
FIG. 5
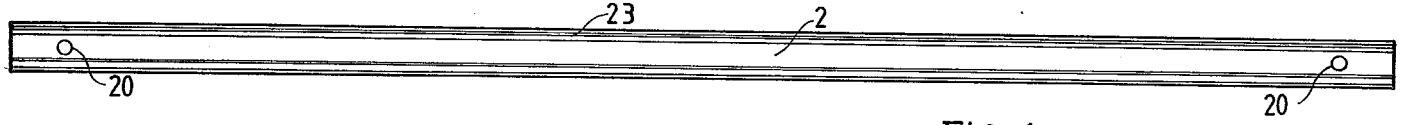
FIG. 6
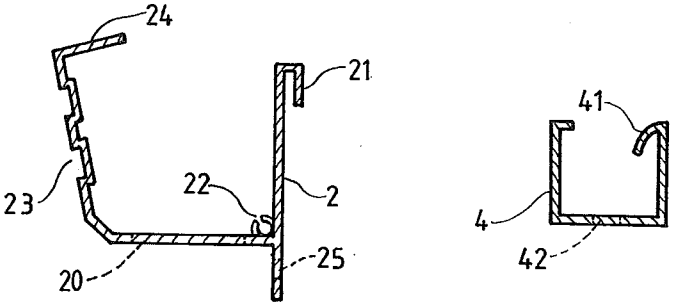
FIG. 7
FIG. 13
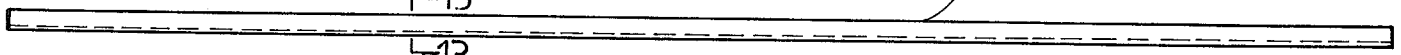
FIG. 11
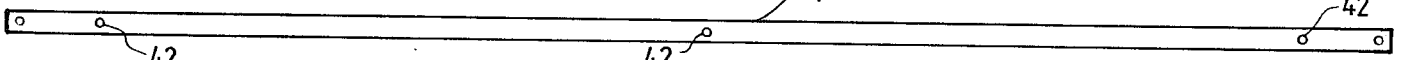
FIG. 12

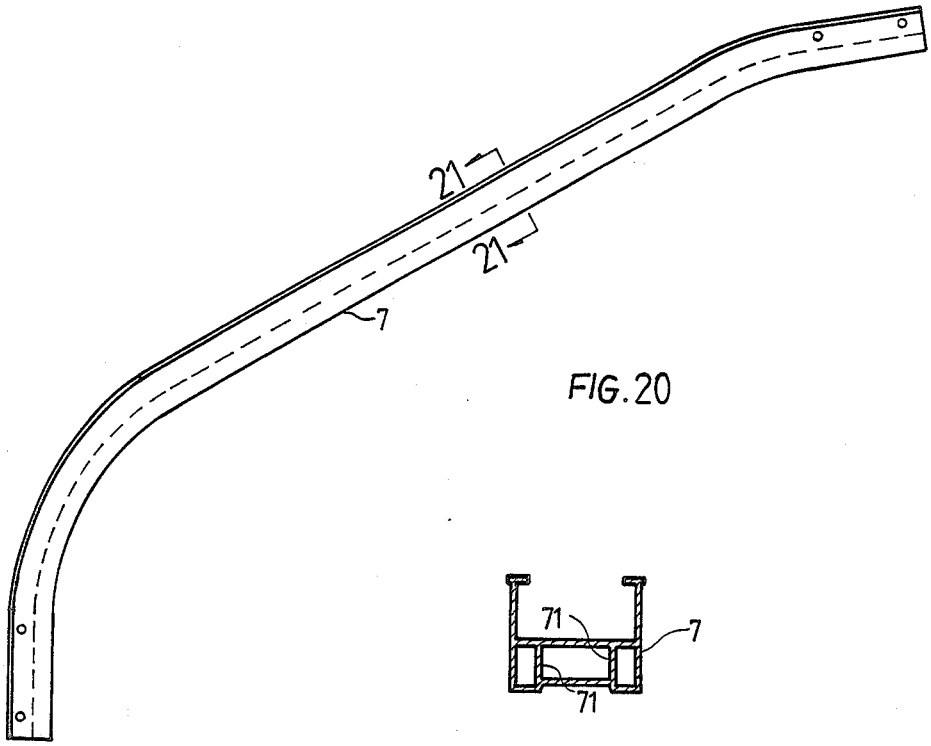
FIG. 20
FIG. 21
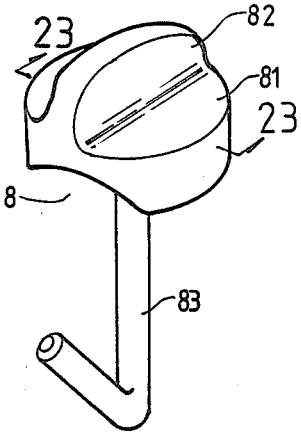
FIG. 22
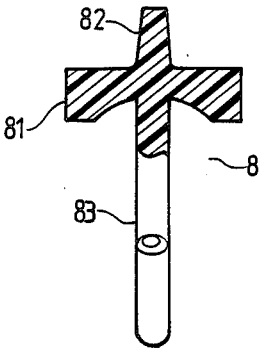
FIG. 23

OVERHANG STRUCTURE

BACKGROUND OF THE INVENTION

Nowadays common structures made of wood or steel have a construction of solid combination by means of nails, bolts or welding, so they are not easily taken apart for reconstructing at somewhere else once they have been constructed. Trusses made of wood may become rotten owing to wet weather or insects after several years of use, so keeping them always in good shape would be difficult and troublesome. In addition, necessary processes in treating them for protection from moisture and corrosion are inconvenient. Especially, they are not suitable for export to foreign countries because of heavy weight and large volume.

Structures made of steel are commonly welded together, but they are vulnerable to moisture as well, and painting processes for resisting rust are complicated and not durable as long as paints peel off over time, especially in an island country. Moreover, they do not have an advantageous structure for mass production, so they cannot be exported to compete in the international market. In view of the above-mentioned drawbacks, the inventor has worked out this new structure.

SUMMARY OF THE INVENTION

This invention, an improved structure, has the following objects.

1. To furnish a simple structure possible to assemble or to dismantle and to satisfy the basic condition for export.
2. To improve common structures of wood or steel, which are improper for export.
3. To lengthen the usable span of life of a structure and to lessen the cost for maintaining it in good shape and good working order.
4. To get rid of the disadvantages of common structures of wood or steel, the susceptibility to corrosion, rust, dropping of paint, the limited life span, etc.
5. To improve the draining method and to prevent water splashing.
6. To furnish a light, practical structure for easy dismantling and reconstruction at some place else.
7. To furnish a structure for mass production improving the uneven quality of those made of wood or steel, which are totally made by hand.
8. To effectively lessen the official expenditure for buying structures used for public construction and maintaining them.
9. To provide more durable, more effective aluminium alloy structures than wooden or steel ones.
10. To expand export of structures.

This improved structure is constructed by assembling a number of posts standing on the ground, the same number of rafters as the posts combined with the posts at one end with bolts, a rear beam combined with the upper rear side of the posts, the same number of struts as the posts slantingly combined with the posts at their lower part and with the rafters at their upper part for supporting the rafters, a front beam combined with the front end of the rafters, a number of auxiliary poles fixed at the same distance between the front beam and the rear beam on the rafters for supporting the roof sheathing, two fascias combined at the right and the left side with the ends of the front beam, the rear beam and the auxiliary poles for pressing the edge of the roof sheathing and two drain chains set separately from the right and the left end of the rear beam to the ground for draining the rain falling on the roof.

BRIEF DESCRIPTION OF THE DRAWINGS

FIG. 5 is a rear view of the rear beam in this invention.

FIG. 6 is a top view of the rear beam in this invention.

FIG. 7 is a cross-sectional view of 7—7 line on FIG. 5.

FIG. 11 is a front view of the auxiliary pole in this invention.

FIG. 12 is a bottom view of the auxiliary pole in this invention.

FIG. 13 is a cross-sectional view of 13—13 line on FIG. 14.

FIG. 20 is a side view of the strut in this invention.

FIG. 21 is a cross-sectional view of 21—21 line on FIG. 20.

FIG. 22 is a perspective view of the assembly nail in this invention.

FIG. 23 is a cross-sectional view of 23—23 line on FIG. 22.

DETAILED DESCRIPTION OF THE INVENTION

Figure 1:
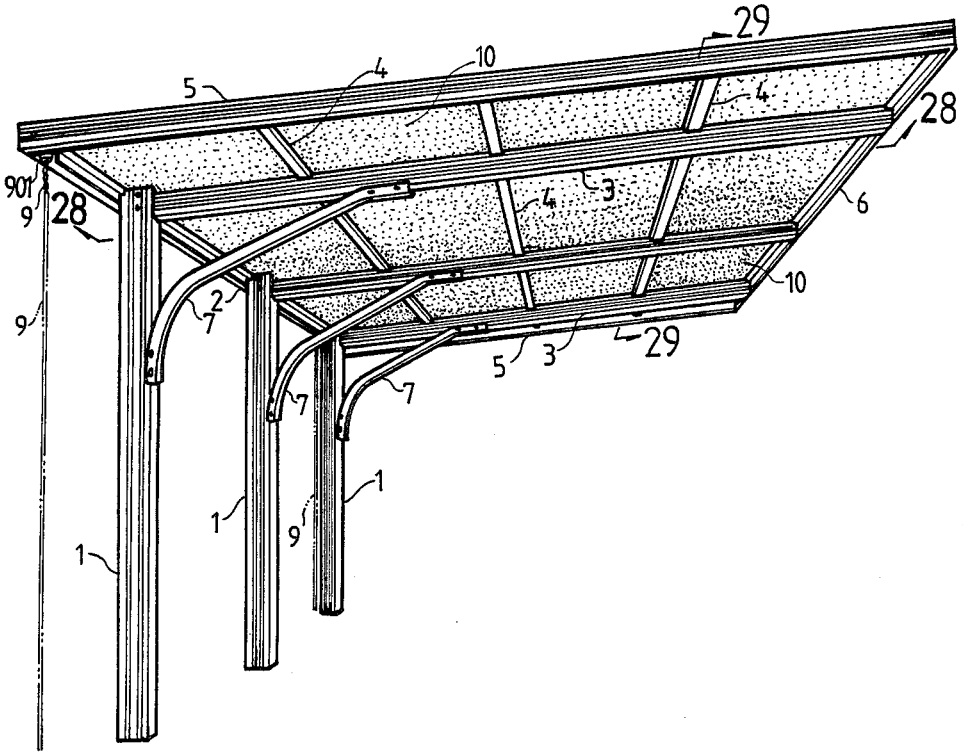
FIG. 1 is a general view of this improved structure in this invention.

This improved structure as shown in FIG. 1 comprises post 1, rear beam 2, rafter 3, auxiliary pole 4, fascia 5, front beam 6, strut 7, assembly nail 8 and drain chain 9 as its main parts.

Figure 4:
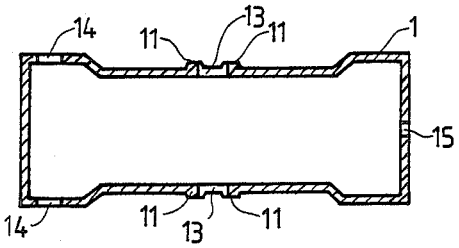
FIG. 4 is a cross-sectional view of 4—4 line on FIG. 3.
Figure 2:
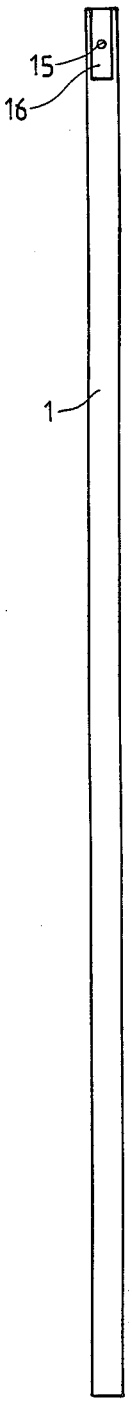
FIG. 2 is a front view of the post in this invention.
Figure 3:
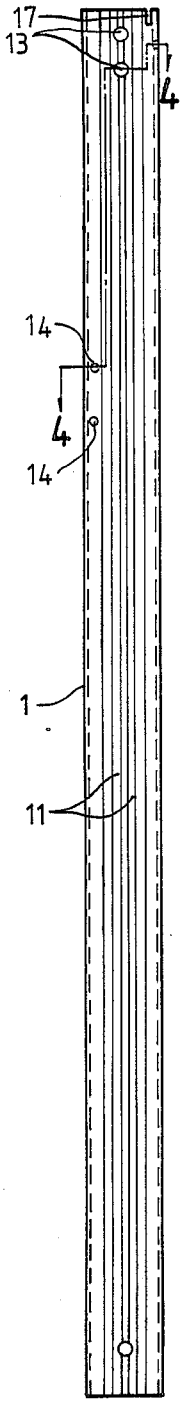
FIG. 3 is a side view of the post in this invention.

Post 1 as shown in FIGS. 2, 3 and 4 is provided with two parallel vertical ribs 11 on both wide sides in order to augment the supporting force and the strength of post 1, two holes 13 at the upper end between both vertical ribs 11 for connecting rafter 3, two holes 14 at the upper middle part for connecting strut 7, bolt hole 15 at the rear side of the upper end for connecting rear beam 2, a bolt hole at the bottom end for fixing post base 12 which is to be buried in the ground, and notch 16 at the front side of the upper end for the rear end of rafter 3 to be placed in.

Next, rear beam 2 as shown in FIGS. 5, 6 and 7 is provided with hook 21 at the front upper edge to hook in notch 17 of post 1, screw holes 22 at both ends for the rear end of right and left fascia 5 to be fixed with rear beam 2 with screws, lengthwise reinforcing rib 23 in the rear wall and L-shaped pressing wall 24 at the rear upper edge for the rear edge of roof sheathing 10 to fit in. Drain chains 9 are set at the right and left ends of rear beam 2 hanging down to the ground for guiding the rain collected by rear beam 2 to flow down.

Rear beam 2 is steadfastly assembled with post 1 by means of bolts which screw in bolt holes 25 bored in the front side of rear beam 2 and just directly below hook 21.

Figure 8:
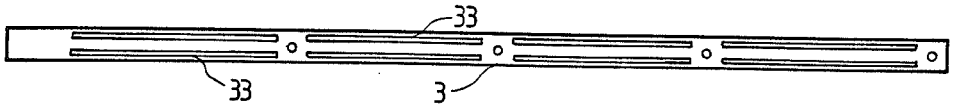
FIG. 8 is a top view of the rafter in this invention.
Figure 9:
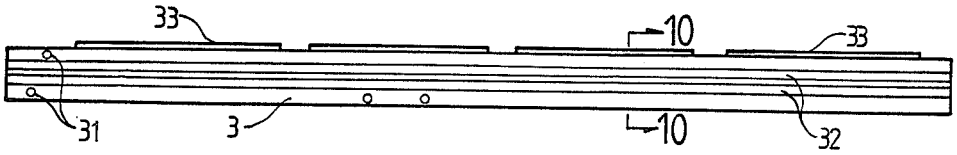
FIG. 9 is a front view of the rafter in this invention.
Figure 10:
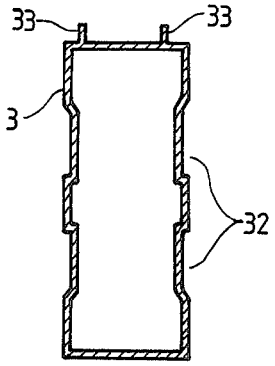
FIG. 10 is a cross-sectional view of 10—10 line on FIG. 9.

Next, rafter 3 as shown in FIGS. 8, 9 and 10 is provided with two bolt holes for bolts 31 to screw in to combine with post 1, reinforcing rib sides 32 at both wide sides to increase its supporting force and strength, two discontinuous parallel ridges 33 on the upper side to increase its upper strength, and two screw holes at the middle rear part for the upper end of strut 7 to combine with, whose lower end is to be combined with post 1. Several bolt holes are bored in the upper side of rafter 3 for combining auxiliary poles 4 on rafters 3 with bolts, and a screw hole is bored in the front upper edge for combining front beam 6, and cover 34 is added in the front end.

Auxiliary pole 4 shown in FIGS. 11, 12 and 13 is provided with hook edge 41 bending inward at one upper side for assembly nail 8 to assemble roof sheathing 10 with auxiliary poles 4, and holes 42 at the bottom side corresponding to the location of rafters 3 for fitting auxiliary poles 4 on rafters with bolts.

Figure 16:
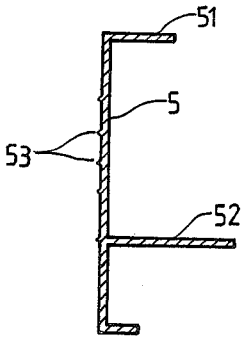
FIG. 16 is a cross-sectional view of 16—16 line on FIG. 14.
Figure 14:
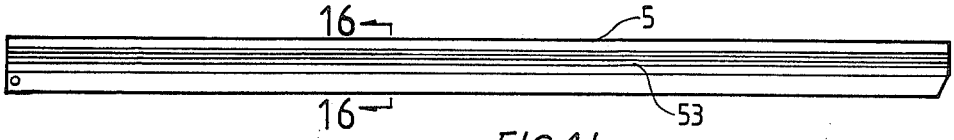
FIG. 14 is a side view of the fascia in this invention.
Figure 15:
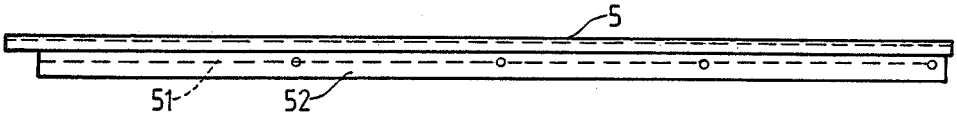
FIG. 15 is a top view of the fascia in this invention.

Fascia 5 shown in FIGS. 14, 15 and 16 is symmetrically fitted at the right and the left sides of the truss, shaped like E and provided with upper horizontal flat wall 51 for pressing roof sheathing 10, middle horizontal flat wall 52 which is fixed with screws to touch the lower edge of auxiliary pole 4 and those of front and rear beams 6 and 2. The rear end of fascia 5 is united with rear beam 2 with a screw screwing through screw hole 22, and there are reinforcing ribs 53 set lengthwise on the vertical outside wall of fascia 5.

Figure 17:
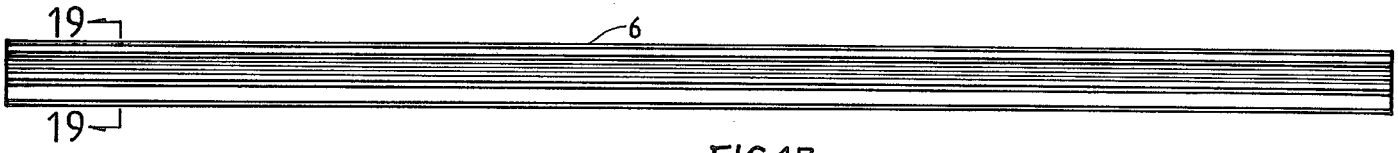
FIG. 17 is a front view of the front beam in this invention.
Figure 18:
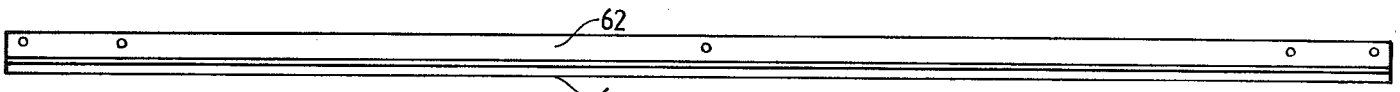
FIG. 18 is a bottom view of the front beam in this invention.
Figure 19:
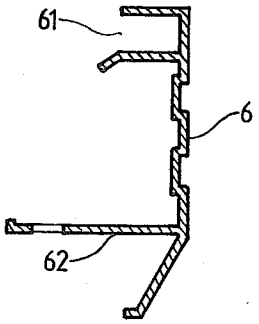
FIG. 19 is a cross-sectional view of 19—19 line on FIG. 17.

Front beam 6 shown in FIGS. 17, 18 and 19 is provided with opening 61 formed by two lengthwise parallel walls at the rear upper part for the front edge of roof sheathing 10 to be set therein, extending-out flat lengthwise wall 62 at the rear lower part for the front end of each rafter 3 to lie thereon and to be bolted with. The lower end of front beam 6 becomes inclined so as to push cover 34 of rafter 3 for keeping cover 34 from falling off after front beam 6 is set in place.

Strut 7 shown in FIGS. 20 and 21 is bent a little at both ends so that it may be combined with rafter 3 and post 1, provided with vertical reinforcing walls 71 in the lower hollow part to increase the supporting strength and the loading force. And as a cross-sectional view shows, strut 7 is provided with two side walls at the upper part for combining with rafter 3 and post 1 and hollow rectangular frame with said walls 71 at the lower part.

Assembly nail 8 shown in FIGS. 22 and 23 is used for fixing roof sheathing 10, which can be a plastic corrugated board or a flexible corrugated board. Assembly nail 8 is provided with nail base 81 at the upper part having vertical ridge 82 for holding and turning said base 81, nail 83 at the lower part which penetrates through a pre-arranged hole in roof sheathing 10 and screws down in hook 41 of auxiliary pole 4 being steadfastly hooked in said hook 41 through the resilient elasticity of roof sheathing 10.

Figure 25:
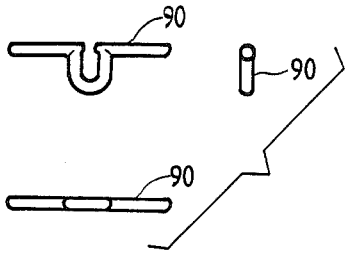
FIG. 25 are three views of the locating bar of the drain chain in this invention.
Figure 26:
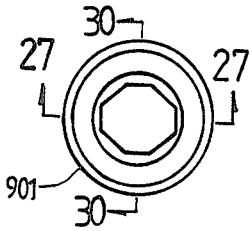
FIG. 26 is a top view of the bucket in this invention.
Figure 27:
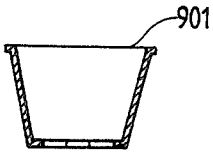
FIG. 27 is a cross-sectional view of 27—27 line on FIG. 26.
Figure 30:
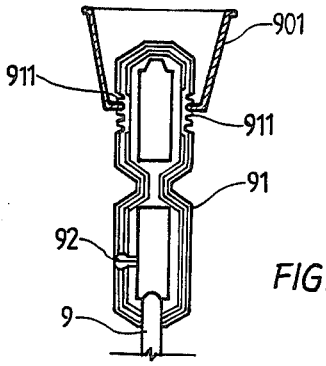
FIG. 30 is a view of the drain chain head combined with the bucket in this invention.
Figure 24:
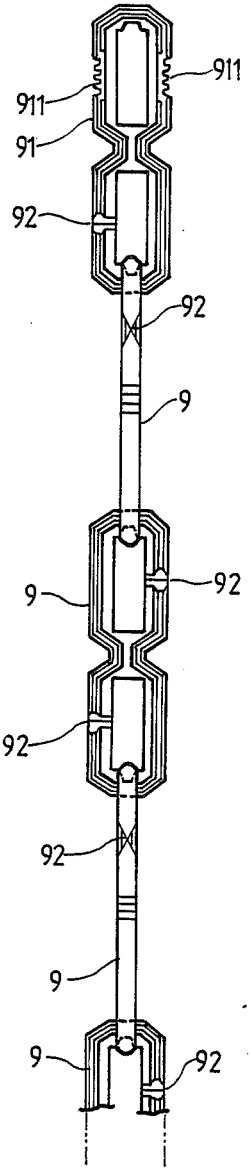
FIG. 24 is a view of the drain chain in this invention.

FIG. 24 shows drain chain 9, which includes locating bar 90 shown in FIG. 25 and bucket 901 shown in FIGS. 26 and 27. Drain chain 9 is constituted with one drain chain head 91 having adjusting wings 911 just at the upper and a number of drain chain rings 93 connected with one another. Adjusting wings 911 are used for changing their own height in the bottom hole of bucket 901. Each drain chain ring 93 is provided with connecting notch 92 having an inclined tip end for connecting with the neighboring drain chain ring 93 at the upper or the lower part so that each drain chain ring can be united with each other to become a long drain chain 9 reaching the ground.

Bucket 901 is placed just under outlet 20 of rear beam 2 and at the top of drain chain 9 so as to let the collected rain to flow down along said chain 9 without splashing around. Bucket 901 is provided with an oval hole at its bottom for adjusting wings 911 of chain head 91 to insert in and to be turned for 90 degrees so as not to fall off bucket 901. Locating bar 90 is to be set on the upper edge of bucket 901 and to be united with drain chain head 91 in order to prevent said head 91 from turning and falling off bucket 901.

Figure 28:
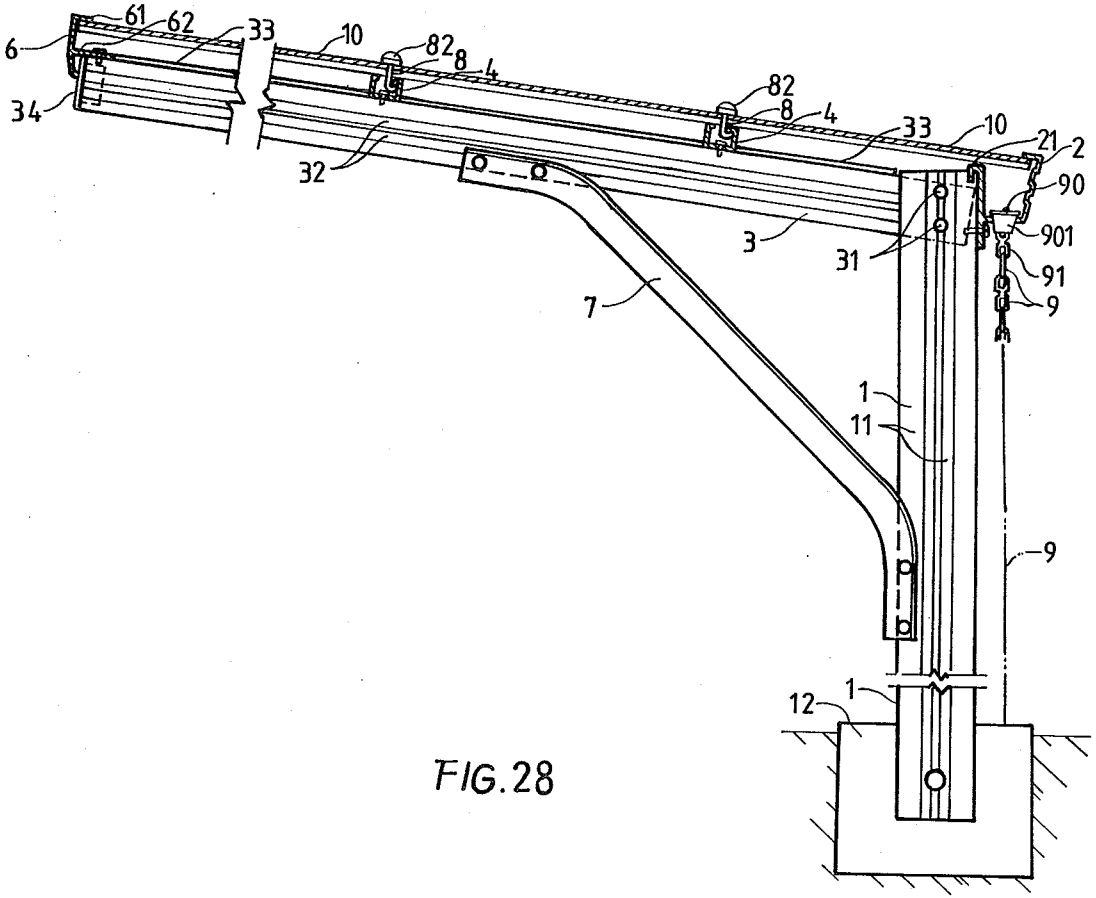
FIG. 28 is a cross-sectional view of 28—28 line on FIG. 1.
Figure 29:
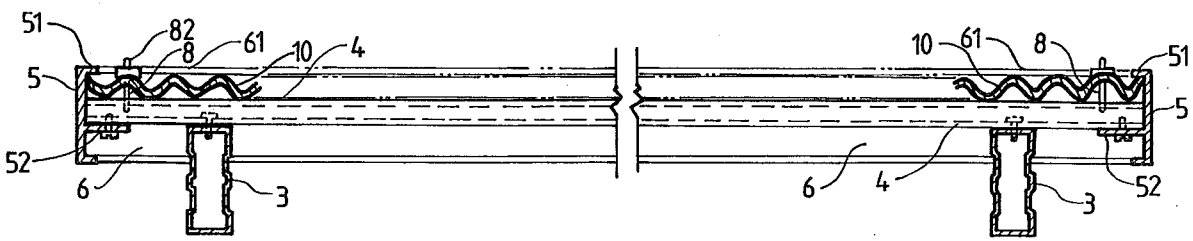
FIG. 29 is a cross-sectional view of 29—29 line on FIG. 1.

The method of assembling this improved structure is described with reference to FIG. 28, which is a cross-sectional view of the assembled structure. First, posts 1, rafters 3, auxiliary poles 4, fascias 5, front beam 6 and struts 7 are assembled together; then roof sheathing 10 are attached with assembly nails 8 in place, the front, the right and the left edges of roof sheathing 10 are separately inserted in openings 61 or pressed by upper flat walls 51 of the right and the left fascias 5. Next, rear beam 2 is to be assembled with posts 1 and the rear side edges of roof sheathing 10 are to be pressed under pressing wall 24 of rear beam 2. Now the assembling process of this structure is accomplished and all the roof sheathing 10 are pressed at every side without any fear of being blown away by wind.

Next, the functions and the advantages of this structure are listed below.

1. A long life span and a solid construction because of aluminium parts with reinforcing ribs.
2. The promising feasibility for foreign export because of the case of dismantling, packing and transporting.
3. A long life span without any fear of wind's blowing away the roof sheathing as it is secured at its side edges.
4. The possibility for mass production.
5. The decrease in the cost.
6. The simpleness in maintaining its function.
7. Breaking the bottleneck of foreign export that wooden or steel structures have.
8. The ease of assembling and setting.
9. Better draining function without noise or splashing because of connecting drain chains.
10. Light weight and no corrosion.
11. Versatility in use, for example, for shading cars or people, etc.

What is claimed is:

1. An improved structure comprising, posts of an aluminium alloy having a hollow rectangular cross-sectional form with two wide sides and a top end, provided with a notch in the top end and with at least two lengthwise recessed or protruded reinforcing ribs at the two wide sides and holes bored between said two reinforcing ribs for assembling with rafters with bolts, rafters of an aluminum alloy with two wide sides, an upper side, and a front and rear end, to be combined with the posts at the rafters' rear ends, having a hollow rectangular cross-sectional form, provided with at least two reinforcing ribs recessed or protruded at the two wide sides, two discontinuous parallel ridges having the same length on the upper side for placing auxiliary poles to increase the strength of the rafters, struts of an aluminium alloy with two ends, an upper part, and a lower part, to be combined with posts at one end and with rafters at the other end for supporting the rafters, having the cross-sectional form that the upper part is provided with two side walls having the same height, the distance between the two side walls being equal to the width of the rafter and the post for attachment, and the lower part is a hollow rectangle with several vertical reinforcing ribs, auxiliary poles of an aluminium alloy having two ends, to be placed crosswide on the rafters between the parallel ridges for supporting roof sheathing, having a U-shaped cross-sectional form with upper corners and a lower edge with a hook set at one upper corner for an assembly nail to be hooked, roof sheathing, having side edges, a front edge, and a rear edge, attached to the rafters, assembly nails provided with an elastic resin nail base having a vertical ridge for catching and a metal bended nail extending down from said base, a right and a left symmetrical fascia of an aluminium alloy, having an E shape, provided with an upper flat horizontal wall for pressing the side edge of the roof sheathing, a middle flat horizontal wall wider than the upper wall for being set at the lower edge of the end of the auxiliary poles, a front beam of an aluminium alloy with a rear upper and lower part, provided with two parallel horizontal walls forming an opening at the rear upper part for placing in the opening the front edge of the roof sheathing and a horizontal wall at the rear lower part for combining with the upper side of the front end of the rafter with screws, a rear beam of an aluminium alloy, having a near U shape for its cross-section with a front upper edge, a rear wall having a top, and two ends, provided with a hook at the front upper edge for hooking in the top end notch of the post, at least two reinforcing ribs recessed or protruded at the rear wall, a L-shaped pressing wall at the top of the rear wall for pressing the rear edge of the roof sheathing, water outlets at both ends and a bucket placed under each outlet and connected with a drain chain hanging down to the ground and, drain chains constituted with a chain head with several adjusting wings and a series of chain rings connected with one another, each ring provided with at least one connecting notch with an inclined tip end for connecting with the counterpart of another chain ring.

2. The improved structure as claimed in claim 1, wherein the drain chain head to be placed in the bucket is provided with several adjusting wings at both sides for adjusting the height of the bucket together with the drain chain to the ground.

* * * * *